US005478034A

United States Patent [19]

Cunningham et al.

[11] Patent Number: 5,478,034

[45] Date of Patent: Dec. 26, 1995

[54] KEYBOARD COMFORT AID

[76] Inventors: Exa E. Cunningham; Kenneth W. Cunningham, both of Rte. 1, Box 33A, Devol, Okla. 73531; John G. Hobbs; Betty L. Hobbs, both of 4105 Clay Ave., Fort Worth, Tex. 76117

[21] Appl. No.: 71,058

[22] Filed: Jun. 4, 1993

[51] Int. Cl.[6] ..... B43L 15/00

[52] U.S. Cl. ..... 248/118.5; 248/918; 297/411.35

[58] Field of Search ..... 248/118, 118.1, 248/118.3, 118.5; 226/180, 194; 297/411.35

[56] References Cited

U.S. PATENT DOCUMENTS

| | | | |
|---|---|---|---|
| 1,628,030 | 5/1927 | Catlett | 248/118 X |
| 4,971,393 | 11/1990 | Maisenhalder | 248/118 X |
| 4,996,977 | 3/1991 | Tiedeken | 248/118 X |
| 5,108,057 | 4/1992 | Dandy, III et al. | 248/118 |
| 5,135,190 | 8/1992 | Wilson | 248/118.1 |
| 5,158,256 | 10/1992 | Gross | 248/118.3 |
| 5,183,230 | 2/1993 | Walker et al. | 248/118.3 X |
| 5,215,282 | 6/1993 | Bonatti | 248/118.3 X |
| 5,281,001 | 1/1994 | Bergsten et al. | 297/411.35 X |

OTHER PUBLICATIONS

Catalog by LMB Hand Rehab Products of California–(page showing Model #9800 and p. 6).

Catalog entitled "Ergonomics at Work" produced for Bill Warren Office Products, Oklahoma City, Okla., pp. 2–4 and 9.

*Primary Examiner*—Blair M. Johnson

*Attorney, Agent, or Firm*—Dougherty, Hessin, Beavers & Gilbert

[57] ABSTRACT

A wrist support device for alleviating repetition-induced limb soreness and agitation consisting of an adjustable position roller assembly secured adjacent a manipulable control panel for the purpose of supporting the operator's wrists and/or forearms in a natural but operative position. The device uses a slide rod and linear bearings to provide the support element.

16 Claims, 2 Drawing Sheets

KEYBOARD COMFORT AID

BACKGROUND OF THE INVENTION

1. Field of the Invention

The invention relates generally to a comfort device for use by a keyboard operator to reduce tiredness and stress and particularly to avoid and/or relieve pain due to carpal tunnel syndrome and related disorders of the wrist.

2. Description of the Prior Art

The prior art includes a number of recent developments for use at keyboard stations for lessening tiredness and easing any strains that stem from long operation and repetitive muscle movements. A common and troublesome condition that interferes with repetitive use of the hands is known as carpal tunnel syndrome, and it is caused when too much pressure is applied on the median nerve that runs through the operator's wrist. The syndrome results in pain, numbness and tingling which can happen at anywhere and any time, and which may get progressively worse if the condition is allowed to persist. Alleviation of the effects of carpal tunnel syndrome and related discomforts is brought about by providing support for the operator's wrists in the keyboard position, and such supports are manifest in various forms of structure.

One type of support device that is used variously in combination with keyboard installations is a form of resilient support, i.e., a support bar covered by soft, cushioning material, that is aligned across in front of the keyboard so that the operator can rest both wrists thereon while operating keys. This is by far the simplest and most common approach to alleviation of the keyboard operator problem. Another form of aid is an extending lever structure known as DATA ARM™ which functions to both position and support the operator's arms during work activity. The device maintains neutral wrist position during horizontal movement across the keyboard, while allowing hands and arms to float across the keyboard without ulnar deviation. This eliminates compression of the carpal tunnel and causes the user's arms to float above the work surface as supported on ball bearing pivot arms. Yet another comfort aid for keyboard operators is known as the KINESIS™ Ergonomic Keyboard which is actually a keyboard that fits the operator's hands, i.e., the keyboard is shaped with undular curvature that conforms to the shape and movements of the operator's hands thereby to reduce the stresses that could contribute to injury while maintaining the traditional alphanumeric key layout intact.

Still other prior art hand supports are illustrated in the catalog of LMB Hand Rehab Products, Inc. at page 11 which is entitled Ergonomic Keyboard Products. This illustrates each of the linear wrist rests as well as the slidable wrist support models which include a lateral slide rod supporting a suitable wrist rest member.

SUMMARY OF THE INVENTION

The present invention relates to a support device having several degrees of freedom in supporting the wrists of a keyboard operator thereby to alleviate tiredness and distortion leading to carpal tunnel syndrome, tendonitis, and the like. The device includes a base portion which may be placed in interlocked position adjacent a keyboard or other manual office equipment in order to position the wrist support members relative thereto. The wrist support members consist of resilient, cushioned rolls formed around a linear bearing element which rides on an elongated, lateral support rod. The support rod is positionable relative to the keyboard for a desired height and proximity and, as the operator rests wrists on respective support rollers, each is free both to roll and to slide sideways relative to the operating keyboard or control panel.

Therefore, it is an object of the present invention to provide an ergonomic wrist support device for use in alleviating pain and fatigue that may arise from various forms of repetitive motion.

It is also an object of the present invention to provide a keyboard wrist support device that is extremely rugged yet readily employed and manipulable into position relative to a keyboard.

It is yet further an object of the present invention to provide a keyboard operating rest that will avoid wrist injury, tendonitis and the like that may occur from the operator's repetitive movements.

Finally, it is an object of the invention to provide a rest device that freely supports a keyboard operator's wrists through any of various backward, forward and/or sideways motions while continually maintaining the operator's fingers in proper position.

Other objects and advantages of the invention will be evident from the following detailed description when read in conjunction with the accompanying drawings which illustrate the invention.

DETAILED DESCRIPTION OF THE INVENTION

Figure 1:
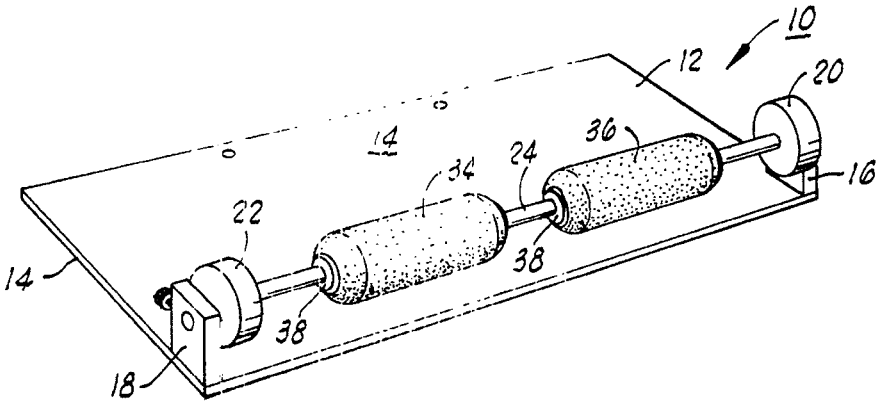
FIG. 1 is a front perspective view of a preferred form of the invention.
Figure 2:
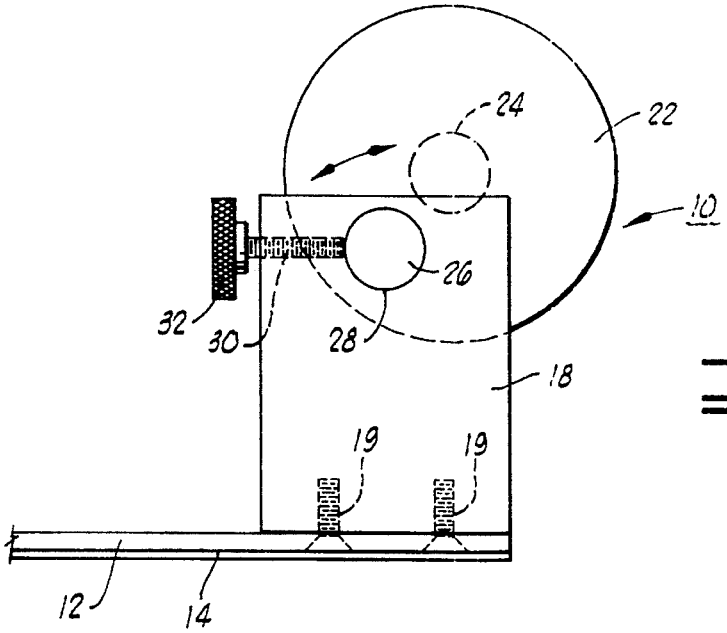
FIG. 2 is a side view in elevation of the front right corner of the device.
Figure 3:
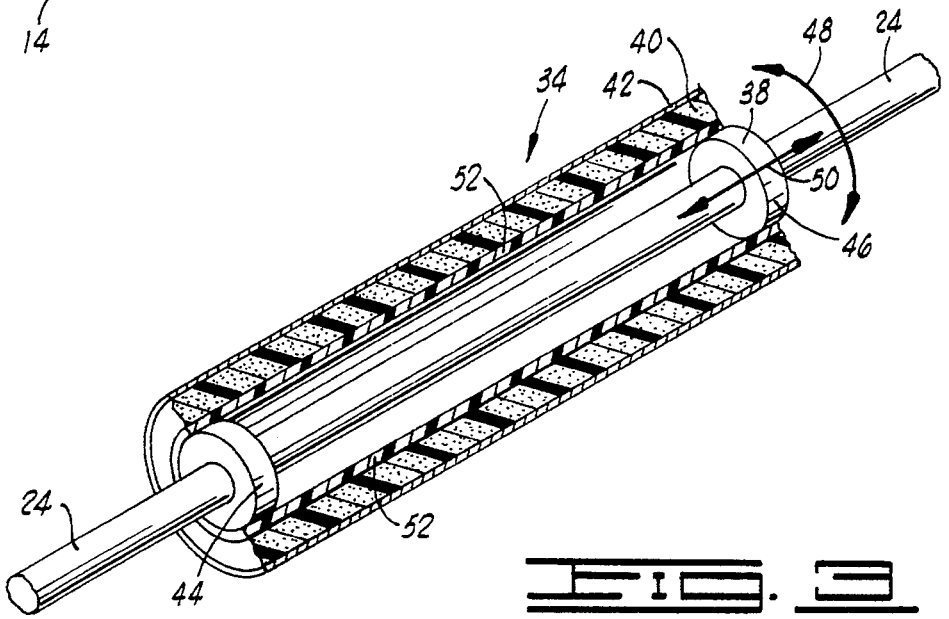
FIG. 3 is a perspective view of a roller and support rod with parts shown in cutaway.

Referring to FIGS. 1, 2 and 3, a wrist support device 10 constructed in accordance with the invention consists of a base plate 12 formed of aluminum, other selected metal or sturdy plastic which is essentially rectangular in shape and of sufficient size to envelope considerable area, particularly a bare forward portion 14 that is suitable for anchoring under associated keyboard equipment (not shown). A suitable coating of resilient elastomer 14 may be secured to the underside for non-skid purposes. The base plate 12 is preferably thin, but not so thin as to be excessively bendable.

A rearward portion of baseplate 12 includes right and left support blocks 16 and 18 as secured to the rearward corners of support plate 12 by means of screws 19 (see FIG. 2). The support blocks 16 and 18 adjustably support rotatable brackets 20 and 22, respectively, which secure a rigid circular rod 24 in extension therebetween. As shown also in FIG. 2, the rigid rod 24 is held securely between brackets 20 and 22, as by force fit, but each of brackets 20 and 22 is movably supported by an off-center pivot block 26 which is rotatably received within off-center hole 28 of respective brackets 20 and 22. Each of upright blocks 16 and 18 includes a set screw 30 having a knurled knob 32 which can be forced against the respective off-center block 26 of upright blocks 16 and 18 to set the angular setting and thereby the height and forward position of rigid bar 24.

The rigid bar 24 is a polish-type rod which receives the slidable rollers 34 and 36 thereon. As shown in FIG. 3, the rollers are constructed to include a slidable linear bearing element 38 in the form of a cylindrical member as covered by cushioning material 40 and an outer cover 42. The linear bearing 38 may be most simply constructed of circular end blocks 44 and 46 constructed of such as Teflon for very easy slidable engagement along rigid rod 24, both circularly and/or longitudinally as shown by arrows 48 and 50. The end blocks 44 and 46 may then be connected by a suitable cylindrical tubing 52 which provides seating for the outer cushioning material.

Other linear bearing devices of more readily slidable construction are commercially available and these may be selected and employed for the similar function as linear bearings 38. The length, diameter and bore size would all be a matter of choice among the commercially available types. The cushioning material 40 may be an outer lining of suitable foam plastic that is sleeved, as for example by heat shrinking, onto the outer cylindrical surface 52, and a suitable cloth cover 42 of soft material is retained thereover for both comfort and gripping purposes. The cover 42 may be adapted for ready removal, cleansing or the like.

In operation, the wrist support 10 is suitably positioned in front of the operator's keyboard at the desired, comfortable height and spacing. Preferably, the front portion 14 of base plate 12 is anchored under some of the heavier parts of the keyboard equipment to maintain stationary reliability. The opposite side knurled knobs 32 are loosened and the respective brackets 20 and 22 are rotated to position the rigid rod 24 and rollers 34 and 36 at the proper proximity and horizontal positioning relative to the keyboard. Thereafter, knurled knobs 32 are tightened down to maintain the arcuate positioning of rotary brackets 20 and 22.

The operator is then free to manipulate the keyboard while the portions of lower wrists are resting on rollers 34 and 36, and tension and stress are greatly alleviated due to the fact that the rollers 34 and 36 are very easily moved either in rotation or in sideways motion. The enablement of two degrees of freedom as the wrists rest on rollers 34 and 36 becomes nearly an autotonic extension of the wrist function.

Figure 4:
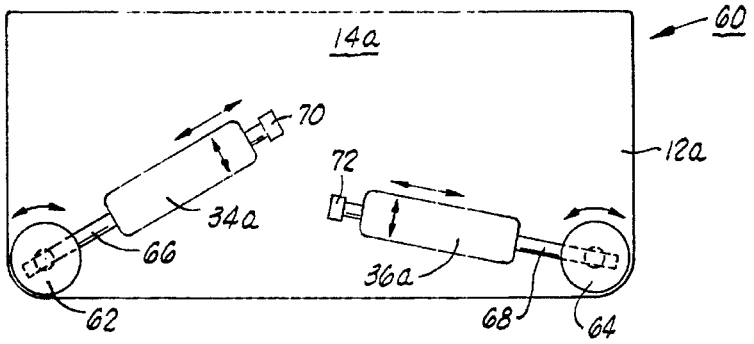
FIG. 4 is a top plan view of a first alternative form of the present invention.

FIG. 4 discloses an alternative form of the invention wherein a wrist rest device 60 provides yet a third degree of freedom for the wrist movement. That is, in addition to forward rotation and lateral movement, the device provides for rotation of the axis of the rigid rod for alignment of the forearms relative to the keyboard. In this case, a base **12*a* includes opposite, rear corner, rotatable support posts 62 and 64 which are each in support of a respective rigid rod 66 and 68. The rigid rods 66 and 68 each have respective rollers 34*a* and 36*a* which are slidably carried thereon and maintained in operative position by means of respective end caps 70 and 72**.

Figure 5:
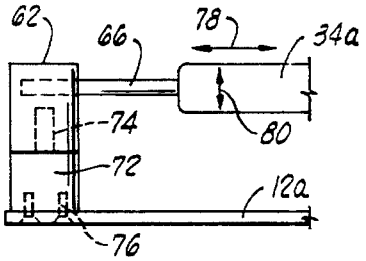
FIG. 5 is a partial rear view shown in elevation of the device of FIG. 4.

As shown in FIG. 5, the rigid rod 66 is supported by force fit in an upper block 62 which is rotatably received down over a lower block 72 having a central axial pivot rod 74 extending upward therefrom. A plurality of securing screws 76 secure the baseplate **12*a* to the underside of lower block 72. Thus, the roller 34*a* has not only the freedom to move rotatively and longitudinally as shown by arrows 78 and 80, but it also has the ability to rotate the rigid rod 66 relative to the baseplate 12*a***.

Figure 6:
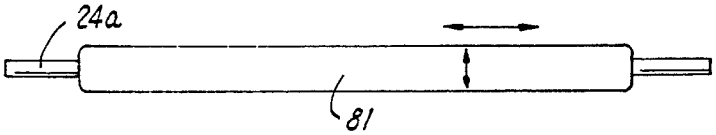
FIG. 6 is a plan view of a roller and support bar of another alternative form of structure.

FIG. 6 illustrates an alternative form of structure wherein the basic rigid rod **24*a* supports a single, long roller 81 having slidable and rotative capability. The long roller 81** is in essence an elongated form of the basic single roller and serves to support both wrists in a more concerted action. This type of support device may be found useful when operating a mouse control or the like.

Figure 7:
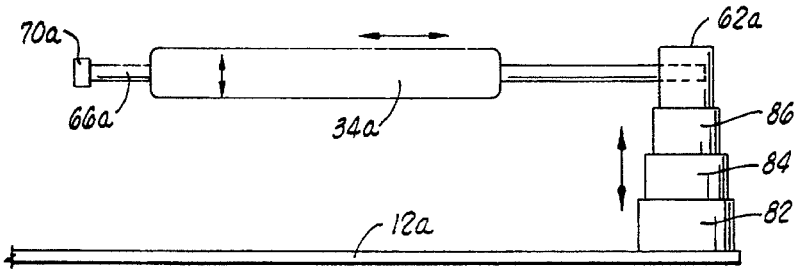
FIG. 7 is a view in elevation of yet another form of the invention.

FIG. 7 illustrates yet another alternative that allows a ready adjustment in height of the rigid rod **66*a* and wrist support roller 34*a*. In this case, a corner support 62*a* is made up of a plurality of telescopic lower sections 82, 84, 86, etc. which are readily expandable and rotatively interconnected so that they enable both angular orientation of rigid rod 66*a* and height adjustment of the support block 62*a*. The telescoping members 82–86 may be controlled as by pneumatic pressure or other control means as they are extendable from the securing point at base 12*a***.

Figure 8:
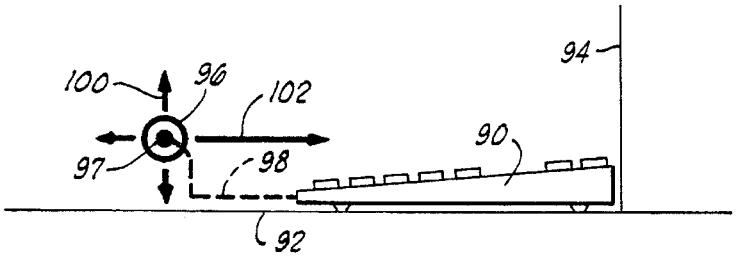
FIG. 8 is a side view functional diagram showing a range of wrist rest positions.

FIG. 8 illustrates a functional side view of tactile operating activity which may include keyboard operation as well as other types of manual control movements. Thus, a control panel 90 may consist of a keyboard or other actuating member which is supported on a surface 92 adjacent a bracing wall or equipment panel 94. Support rollers 96 on a slide rod 97 are then adjustably positioned by means of a suitable support 98. In the case of a mouse control, there may be a single roller 96, but in most tactile operations two hands and, therefore, two support rollers 96 will be required.

The support 98 may be any of several well-known mechanical support members which will provide two-way adjustable positioning of the slide rod 97. There should be adjustment up and down as per arrow 100 in order to accommodate the operator's height preference. This is a simple matter of comfort and will vary significantly from operator to operator. There is also longitudinal adjustment as per arrow 102 to accommodate an operator's choice of wrist support versus forearm support. Thus, the range of adjustment horizontally becomes another important consideration because some operators will prefer the more distant forearm roller support to the up-close wrist mode. Any of various mechanical supports 98 may be selected, the important factors being the ability to adjust low enough relative to the keyboard while still being capable of a wide range of horizontal positioning.

In the larger view, it may develop that troublesome injuries or conditions resulting from repetitive motion operation of machines is a major ergonomic concern in many areas of endeavor. In any cases of this nature, supported restful motion of the limbs becomes an important remedial aid. When the operating limb and appendage is supported in its most natural position while performing the required motion, the physical function takes place at most optimum conditions.

It is also contemplated that wrist support devices in accordance with the present invention may well become standard fixtures in and around work areas using keyboards. Accordingly, it may develop that wrist rests become standard addenda or attachments to such keyboard devices. Thus, the slidable roller cushions may be directly supported by slide rod fixtures that are an integral part of the keyboard and operating equipment and readily brought into operation by the keyboard user. In this case, the keyboard itself may provide the base structure as the keyboard comfort rollers are removably attached thereto.

The foregoing discloses a novel form of wrist support device for use in gaining ergonomic advantage in the work place. The problems of carpal tunnel syndrome, tendonitis and other debilitating conditions have become a considerable problem in the work place today and advances such as the present device serve to greatly alleviate some of the aggravating problems that contribute to loss of work time, efficiency and enjoyable environs.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A wrist rest device for use adjacent a keyboard, comprising:

an elongated, cylindrical slide rod;

means supporting said slide rod in a horizontal attitude and generally in parallel along the front of said keyboard; and at least one roller slidably supported on said slide rod and having capability of both rotative and longitudinal movement while giving wrist support.

2. A wrist rest device as set forth in claim 1 wherein said at least one roller comprises:

first and second roller members each including respective first and second linear bearings which are received on said slide rod.

3. A wrist rest device as set forth in claim 1 wherein said means supporting said slide rod comprises:

first and second spaced support members; and a base member of generally rectangular shape having said first and second support member secured on opposite sides.

4. A wrist rest device as set forth in claim 2 wherein said means supporting said slide rod comprises:

first and second spaced support member; and a base member of generally rectangular shape having said first and second support member secured on opposite sides.

5. A wrist rest device as set forth in claim 3 wherein each of said support members comprises:

a support block rigidly secured to said base member; and a rotatable bracket secured to said support block and adjustably supporting said slide rod at a selected height above said base member.

6. A wrist rest device as set forth in claim 4 wherein each of said support members comprises:

a support block rigidly secured to said base member; and a rotatable bracket secured to said support block and adjustably supporting said slide rod at a preselected height above said base member.

7. A wrist rest device for use with an operator's keyboard, comprising:

a base member for rigid positioning relative to said keyboard;

at least one block rotatable about a vertical axis while secured on said base member and supporting a slide rod extending generally parallel to said base member; and a roller positioned on said slide rod for slidable and rotatable movement while giving wrist support.

8. A wrist rest device as set forth in claim 7 wherein said at least one rotatable block and roller comprises:

first and second rotatable blocks each secured in spaced relationship on said base member in support of respective first and second slide rods; and first and second rollers positioned on respective first and second slide rods.

9. A wrist rest device as set forth in claim 8 wherein said first and second rotatable blocks each comprise:

a lower block secured in selected position on said base member; and an upper block rotatively secured to said lower block and supporting a respective slide rod in generally horizontal attitude.

10. A wrist rest device as set forth in claim 9 wherein:

each of said first and second rollers is formed around a linear bearing having slidable and rotative motion.

11. A wrist rest device as set forth in claim 8 wherein:

each of said first and second rotatable blocks is extendable and retractable in height.

12. A wrist rest device as set forth in claim 11 wherein:

each of said first and second rotatable blocks is telescopically adjustable in height.

13. A limb support device for use with a tactically operated machine, comprising:

an elongated, round slide rod;

first and second rollers slidably and rotatably retained on said slide rod in adjacent relationship, said rollers each presenting a relatively soft outer surface; and support means for adjustably positioning said slide rod rigidly relative to said machine.

14. A device as set forth in claim 13 which is further characterized to include:

first and second linear bearing members axially supporting each of said first and second rollers.

15. A device as set forth in claim 13 wherein said support means comprises:

first and second support members each rigidly secured relative to said machine and supporting opposite ends of said slide rod.

16. A device as set forth in claim 14 wherein said support means comprises:

first and second support members each rigidly secured relative to said machine and supporting opposite ends of said slide rod.

* * * * *